United States Patent [19]

Kreissig

[11] 4,327,649

[45] May 4, 1982

[54] MAXIMUM TRACTION LOCOMOTIVE

[75] Inventor: Ernst F. Kreissig, Seuzach, Switzerland

[73] Assignee: Schweizerische Lokomotiv-und Maschinenfabrik, Winterthur, Switzerland

[21] Appl. No.: 38,214

[22] Filed: May 11, 1979

[30] Foreign Application Priority Data

Mar. 6, 1979 [CH] Switzerland ..... 2166/79

[51] Int. Cl.[3] ..... B61F 3/08; B61F 5/18; B61F 5/22

[52] U.S. Cl. ..... 105/199 R; 105/182 R; 105/184; 105/199 C

[58] Field of Search ..... 105/199 R, 182 R, 184, 105/199 C, 199 A, 157 R, 158 R, 199 CB

[56] References Cited

U.S. PATENT DOCUMENTS

| | | | |
|---|---|---|---|
| Re. 4,238 | 1/1871 | Pettit | 105/199 C |
| 640,507 | 1/1900 | Uebelacker | 105/184 |
| 2,067,483 | 1/1937 | Ferris | 105/199 C X |
| 2,704,518 | 3/1955 | DeBuzareingues | 105/199 R |
| 3,352,256 | 11/1967 | Saima | 105/199 R |
| 3,719,152 | 3/1973 | Harter | 105/199 R X |

*Primary Examiner*—Joseph F. Peters, Jr.
*Assistant Examiner*—Howard Beltran
*Attorney, Agent, or Firm*—Kenyon & Kenyon

[57] ABSTRACT

In the railroad propulsion vehicle described, the traction forces are transmitted from the trucks to the vehicle body at a height h above the upper rail edges. The secondary support springs are each arranged at a distance x from the transverse center plane of the truck between the latter plane and the adjacent body end in order to balance out the tilting-up moment exerted on the leading truck. The distances h and x are adjusted to a desired distribution of the axle pressures $A_1$ to $A_4$ or the deviations $Q_1$ to $Q_4$ from a mean axle pressure value. On the basis of the chosen distribution, the values x and h can be calculated in a simple manner.

The distribution of the deviations Q is, for instance, chosen so that all three leading axles are equally load-relieved and the fourth axle is loaded accordingly. According to another embodiment, the first axle is less load-relieved by $\Delta Q$ than the second axle, and the latter is load-relieved the same as the third axle. This takes into consideration that the first axle encounters a somewhat lower friction coefficient than the following axles.

6 Claims, 5 Drawing Figures

Figure 1:
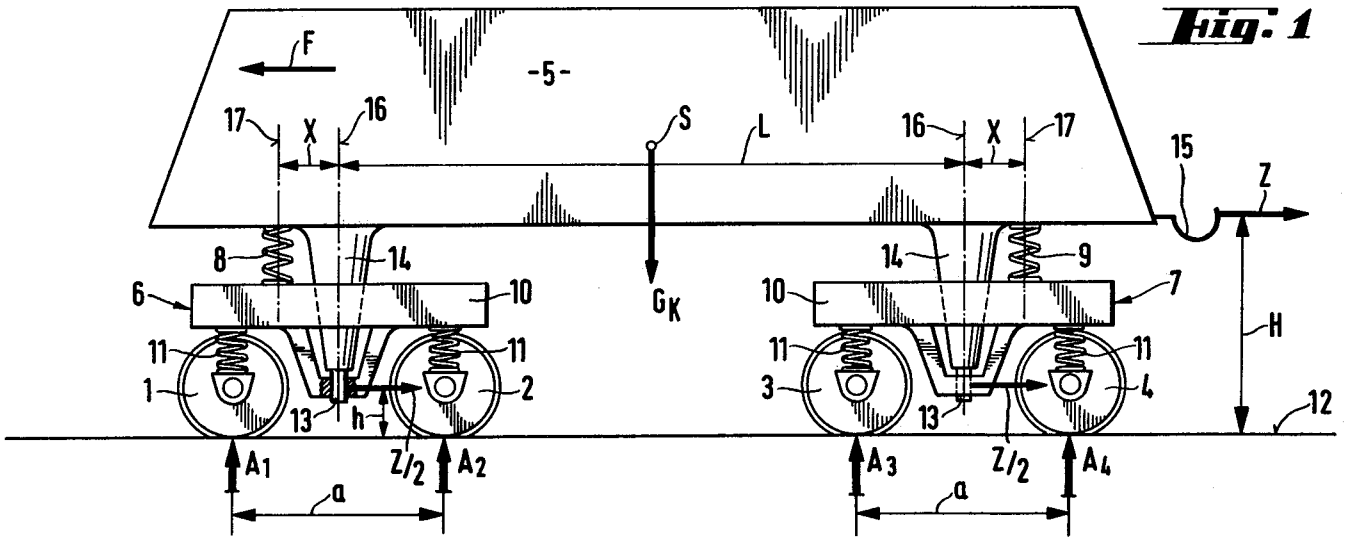

-5-
F
S
$G_K$
L
X
X
H
Z
a
h
$Z/2$
$Z/2$
$A_1$
$A_2$
$A_3$
$A_4$
1
2
3
4
6
7
8
9
10
11
12
13
14
15
16
17

$A_1$
$A_2$
$A_3$
$A_4$
$Q_1$
$Q_2$
$Q_3$
$Q_4$
+Q
-Q
$\frac{G_{TOT}}{L}$

MAXIMUM TRACTION LOCOMOTIVE

This invention relates to a railroad propulsion vehicle. More particularly, this invention relates to a manner of transmitting traction forces between two two-axle (trucks) and a vehicle body supported thereon.

As is known, in railroad propulsion vehicles with two two-axle trucks, a moment $Z \times H$ comes about if a traction force Z is exerted on the vehicle body at the draw hook height H. This moment load-relieves some axles relative to an average value which corresponds to one-quarter of the total weight of the railroad vehicle, and additionally loads other other axles. The same applies to the individual truck. If the traction force Z/2 of the truck is transmitted to the body at a height h above an upper rail edge, a moment $(Z \times h)$ is produced which causes an additional load relief to the axle which is forward in the travel direction of the truck. Since the motors of the individual axles generally deliver equal power in operation, the traction force per axle being Z/4, the total traction force Z which can be transmitted to the track by friction is limited by the axle pressure of the most-load-relieved axle.

The most-load-relieved axle of a railroad vehicle is usually the leading axle of the leading truck. This axle has a further disadvantage in that, as a rule, worse friction conditions are encountered, especially under bad weather conditions. This further reduces the ability of the truck to transmit traction forces. It is therefore an important concern to keep the maximum load relief, i.e., the load relief of the first axle in the travel direction, as small as possible.

Numerous constructions are known which are aimed at keeping the axle load relief of a railroad vehicle within permissible limits. Low-slung traction devices, for instance as described in U.S. Pat. No. 3,352,256, are used which transmit the traction force of the trucks in the region of the upper rail edge, so that no moment $(Z/2) \times h$ is produced. In another construction, the traction force is transmitted via king pins at a certain height h above the upper rail edge. The moment $(Z/2) \times h$ produced thereby is cancelled by introducing additional, essentially vertical forces at a suitable point between the body and the truck, for instance, by pneumatic cylinders. However, all these devices are relatively complicated, and usually require a certain amount of maintenance.

Accordingly, it is an object of the invention to provide a railroad propulsion vehicle, in which the deviations of the axle pressures of the different axles from a mean value of the axle pressure can be chosen relatively freely and a distribution of these deviations, predetermined in accordance with the requirements of each case, can be incorporated into the railroad vehicle by simple design measures.

Briefly, the invention provides a railroad propulsion vehicle which is comprised of a vehicle body, a pair of two-axle trucks supporting the body thereon, means for transmitting traction forces via the trucks to the body at a predetermined height and a pair of support means. Each support means is disposed between a respective truck and the body for supporting the body on the truck and each support means is disposed between a transverse center plane of a respective truck and an adjacent end of the vehicle body.

By arranging the support means in the above manner, the two respective outer axles are loaded by a larger share of the weight force of the vehicle body than the two inner axles. Thus, the tilting-up moment acting on the leading truck is reduced accordingly.

In one embodiment of the invention, the support means can each be arranged in the region of a transverse plane of the respective truck and their distances (x) from the transverse center plane and the height (h) at which the traction force is transmitted between the truck and the vehicle body, are adjusted to predetermined values $Q_1$, $Q_2$, $Q_3$, $Q_4$ of deviations of the axle pressures from a mean axle pressure value $G_{TOT}/4$. The Q-values are formed so that they are interlinked by the relation $Q_1+Q_2+Q_3+Q_4=0$, that is, the sum of these values equal zero, and fulfill the moment equilibrium conditions of the entire vehicle. The distance (x) and the height (h) are each of the range of a value calculated from the formula $$x = (Q_1 - Q_2 - Q_3 + Q_4) \cdot \frac{a}{2G_k} \text{ and}$$

$$h = \frac{(Q_2 - Q_1) \cdot \frac{a}{2} + x \cdot \frac{G_k}{2} - \frac{Z \cdot H \cdot x}{L + 2x}}{\left(\frac{Z}{2}\right) - \frac{Z \cdot X}{L + 2X}}$$

wherein

Z designates the total force to be transmitted to the body,

H designates the height measured from the upper rail edge, at which the traction force Z acts on the body;

$G_k$ designates the weight force of the body;

G designates the total weight force of the railroad vehicle;

L designates the distance between the trucks, and a designates the distance between the axles of a truck.

The desired axle pressure distribution in the vehicle is achieved on the basis of predetermined values of the axle pressure deviations corresponding to the pertaining power requirements and friction conditions, without endangering the operational safety and the reliability of the vehicle. The measures used are simple and inexpensive.

According to one embodiment of the invention, the distance x and the height h can correspond to a value, at least approximately, calculated from the formula $$x = \frac{H \cdot Z \cdot a}{G_k (L + a)} \text{ and}$$

$$h = H \cdot \frac{a - 2x}{L + a}$$

For the deviations of the axle pressures, the relations $Q_1=Q_2=Q_3=Q$ and $Q_4=-3Q$ then apply.

This embodiment, in which all three leading axles are equally load-relieved and the corresponding values x and h can be calculated from relatively simple formulas, has the advantage that the largest negative Q-value of the most load-relieved axle, which determines the magnitude of the traction force which can be transmitted, assumes a minimum, and the traction force that can be transmitted assumes a maximum, assuming the same friction coefficients.

According to a second embodiment of the invention, the distance x and the height h can correspond to respective values calculated from the formula $$x = \left(\frac{H \cdot Z}{L + a} + \Delta Q\right) \cdot \frac{a}{G_k}$$

$$h = H\frac{a - 2x}{L + a}$$

The relations $Q_2 = Q_3 = Q_1 - \Delta Q$ and $Q_4 = -(3Q_1 - 2\Delta Q)$ then apply for the deviations of the axle pressures. The first axle is therefore less load-relieved by $\Delta Q$ than the second axle, but the second axle as much as the third. The corresponding values x and h are also found in this case from relatively simple formulas.

This embodiment is advantageous if the first axle encounters a smaller friction coefficient than the following ones, so that it is desirable to load-relieve the first axle somewhat less.

Starting with the assumption that each axle encounters a somewhat large and therefore more favorable friction coefficient than the preceding one, the distance and the height, according to a third embodiment of the invention, can correspond, at least approximately, to a value calculated from the formula $$x = \frac{H \cdot Z + \Delta Q\,(2L + a)}{L + a} \cdot \frac{a}{G_k}$$

$$h = \frac{-\Delta Q \cdot \frac{a}{2} + x \cdot \frac{G_k}{2} - \frac{Z \cdot H \cdot x}{L + 2x}}{\frac{Z}{2} - \frac{Z \cdot x}{L + 2 \cdot x}}$$

Then, the relations $Q_2 = Q_1 - \Delta Q$, $Q_3 = Q_2 - \Delta Q$ and $Q_4 = -3(Q_1 - \Delta Q)$ apply for the deviations of the axle pressures. In this embodiment, each of the three leading axles is therefore more load-relieved by $\Delta Q$ than the preceding one.

Figure 2:
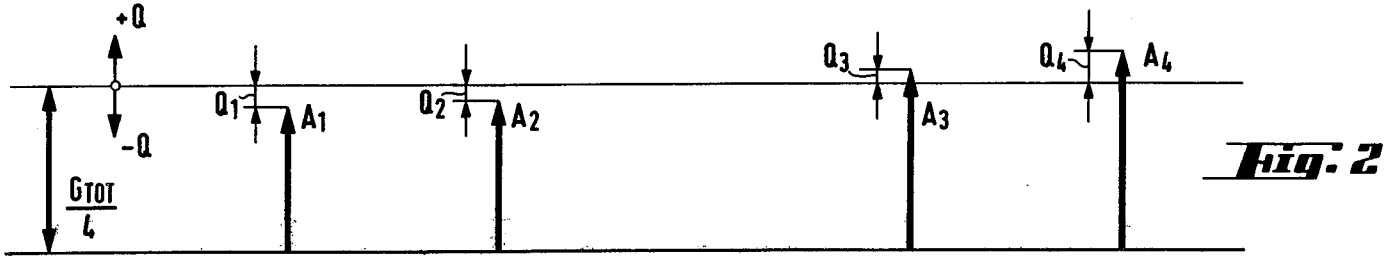
Figure 3:
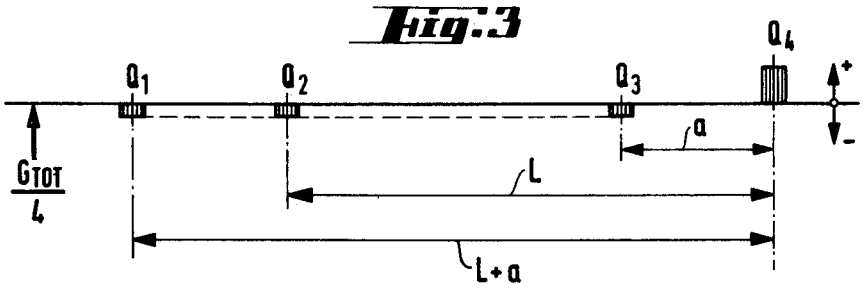
Figure 4:
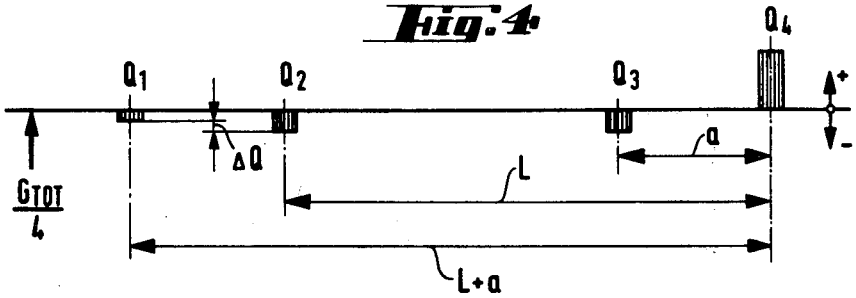
Figure 5:
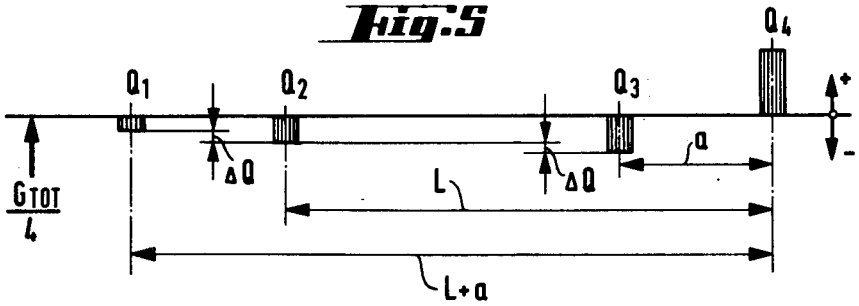

These and other objects and advantages of the invention will become more apparent from the following detailed description and appended claims taken in conjunction with the accompanying drawings in which:

FIG. 1 illustrates a side view of a railroad vehicle with two two-axle trucks and eccentrically arranged secondary springs in accordance with the invention;

FIG. 2 graphically illustrates the axle pressures $A_1$ to $A_4$ at the axles 1 to 4 as per FIG. 1, and the deviations $Q_1$ to $Q_4$ of these axle pressures from a mean axle pressure $G_{TOT}/4$, for a general case;

FIG. 3 graphically illustrates the deviations $Q_1$ to $Q_4$ for a first special case;

FIG. 4 graphically illustrates the deviations $Q_1$ to $Q_4$ for a second special case; and FIG. 5 graphically illustrates the deviations $Q_1$ to $Q_4$ for a third special case.

Referring to FIG. 1, a railroad propulsion vehicle, i.e. a locomotive, moving in a travel direction F has a body 5 supported via support means in the form of secondary springs 8, 9 on two two-axle trucks or undercarriages 6, 7. The body weight force $G_k$ of the body 5 acts at the center of gravity S of the body 5. The trucks 6, 7 each have a truck frame 10, which is supported via primary springs 11 on two axles 1, 2 and 3, 4, respectively, which are arranged at a distance a from each other. The reference symbols of the axles indicate their order in the travel direction, i.e., the axle 1 is the leading axle of the leading truck 6 and the axle 4 is the trailing axle of the trailing truck 7.

The trucks 6, 7 each transmit a traction force of Z/2 to the body 5. This happens at a height h above an upper rail edge 12 on which the vehicle rides, via a king pin 13 which is supported in each truck 6, 7 respectively, and is firmly arranged at the lower end of a bracket 14 fastened to the body 5. The transverse center planes 16 of the trucks 6, 7 are arranged at a distance L from each other.

The pair of secondary springs 8, 9 are arranged on the side facing away from the transverse center plane 16 of each truck 6, 7 at a horizontal distance x in the vicinity of a transverse plane 17. The entire traction force z, which is transmitted by the trucks 6, 7 to the body 5, is delivered to the body 5 at the height H of a draw hook 15. The axle pressures so produced are designated with $A_1$, $A_2$, $A_3$, $A_4$.

The values x and h are adjusted to a desired distribution of the axle pressures $A_1$ to $A_4$ or the deviation $Q_1$ to $Q_4$ of the axle pressures from a mean axle pressure value $G_{TOT}/4$ corresponding to one-quarter of the total vehicle weight.

FIG. 2 relates to the most general case where the distribution of the axle pressures $A_1$ to $A_4$ and therefore, of the deviations $Q_1$ to $Q_4$ is chosen largely freely. Two axle pressures or deviations can be chosen completely arbitrarily, while the other two axle pressures or deviations are determined by the equilibrium conditions of the entire vehicle.

The equilibrium conditions that must be fulfilled are the known relations $\Sigma V = 0$ (equilibrium of the vertical forces)

$\Sigma M = 0$ (equilibrium of the moments).

The corresponding values x and h fulfill the relations:

$$x = (Q_1 - Q_2 - Q_3 + Q_4) \cdot \frac{a}{2G_k} \text{ and}$$

$$h = \frac{(Q_2 - Q_1) \cdot \frac{a}{2} + x \cdot \frac{G_k}{2} - \frac{Z \cdot H \cdot x}{L + 2x}}{\frac{Z}{2} - \frac{Z \cdot x}{L + 2x}}$$

From the equilibrium condition of the vertical forces follows $Q_1 + Q_2 + Q_3 + Q_4 = 0$, which makes it evident that at least one of the deviations Q must be negative. Since the most load-relieved axle, i.e., the one with the largest negative Q-value, determines the magnitude of the traction force that can be transmitted, it is important that the largest negative Q-value be kept as small as possible. The most advantageous value is then obtained if all three leading axles are load-relieved by the same amount and the fourth axle cancels all these load reliefs by a positive Q-value three times as large. All other combinations have at least one axle which would be load-relieved more and which would then determine the maximum traction force that can be transmitted per axle.

The above-mentioned optimum combination $Q_1 = Q_2 = Q_3 = Q_4$ is diagrammatically shown in FIG. 3. The equilibrium conditions lead to the relations $$Q = -\frac{H \cdot Z}{2\,(L + a)} \text{ and } Q_4 = -3Q$$

The corresponding values x and h fulfill the following relations:

$$x = \frac{H \cdot Z \cdot a}{G_k (L + a)} \text{ and } h = H \frac{a - 2x}{L + a}$$

The above-mentioned combination is the most favorable if all wheels can operate with the same friction coefficient. In general, however, the first axle will encounter rather a somewhat smaller friction coefficient than the following ones. It may therefore be advantageous to load-relieve the first axle somewhat less. Such a case is shown diagrammatically in FIG. 4, where the first axle is load-relieved less by ΔQ than the second one, but the second axle is load-relieved as much as the third.

The values x and h fulfill in this case the relations:

$$x = \left( \frac{H \cdot Z}{L + a} + \Delta Q \right) \cdot \frac{a}{G_k}$$

$$h = H \frac{a - 2x}{L + a}$$

From FIG. 5, a distribution of the axle pressures or the deviations Q can be seen which is chosen under the assumption that every axle encounters a somewhat more favorable friction coefficient than the preceding one. This means that each of the leading axles can be load-relieved somewhat more than the preceding one.

Together with the equilibrium conditions for the entire vehicle, the conditions mentioned lead to the relation for x and h:

$$x = \frac{H \cdot Z + \Delta Q \cdot (2L + a)}{L + a} \cdot \frac{a}{G_k}$$

$$h = \frac{-\Delta Q \cdot \frac{a}{2} + x \cdot \frac{G_k}{2} - \frac{Z \cdot H \cdot x}{L + 2x}}{\frac{Z}{2} - \frac{Z \cdot x}{L + 2x}}$$

The advantages of the described arrangement can be achieved particularly if the values x and h are chosen so that they cause one of the three described advantageous combinations of axle pressure relief. The relation of the distances x and h which result in an advantageous distribution of the axle pressures which is of interest in practice and therefore, of the deviations from a mean axle pressure value, can be expressed by the formula $$(0.9 - 4h) \leqq x \leqq (h - 0.14),$$

where x and h are to be entered in meter units.

The arrangement of the support means can also be used, for instance, for the two outer trucks of a railroad vehicle with three trucks; the support at the middle truck is then advantageously arranged in the transverse center plane of the vehicle.

In the following Table, values h and x referred to a known railroad vehicle and the corresponding deviations $Q_1$ to $Q_4$ are listed for the three cases described.

Numerical Examples for Asymmetrical Body Support $G_k$ = 400 kN
Z = 240 kN
H = 1 m
L = 9 m
a = 3 m

| | Case 1 | Case 2 | Case 3 |
|---|---|---|---|
| $Q_1$–$Q_2$ | 0 | 5 | 2.5 |
| $Q_2$–$Q_3$ | 0 | 0 | 2.5 |
| h (m) | 0.225 | 0.219 | 0.244 |
| x (m) | 0.15 | 0.188 | 0.183 |
| $Q_1$ (kN) | −10 | −7.5 | −8.44 |
| $Q_2$ (kN) | −10 | −12.5 | −10.94 |
| $Q_3$ (kN) | −10 | −12.5 | −13.44 |
| $Q_4$ (kN) | +30 | +32.5 | +32.81 |

What is claimed is:

1. A railroad propulsion vehicle comprising a vehicle body;

a pair of trucks supporting said body thereon, each truck having a pair of wheel axles thereon;

means for transmitting traction forces via said trucks to said body at at least approximately the height of said axles, said means including a king pin supported in each respective truck at the height of said axles and fastened to said body in a transverse center plane of a respective truck; and a pair of springs, each said spring being disposed between a respective truck and said body for supporting said body on said respective truck, each said spring being disposed between said transverse center plane of a respective truck and an adjacent end of said vehicle body on a centerline spaced a given horizontal distance from said center plane in the region of a transverse plane of a respective truck.

2. A vehicle as set forth in claim 1 wherein each said king pin is vertically guided in a respective truck in slidable relation.

3. A rail road propulsion vehicle comprising a vehicle body;

a pair of two-axle trucks supporting said body thereon, each said truck having a frame, a pair of axles and primary springs suporting said frame on said axles;

means connecting each respective truck to said body for transmitting traction forces from said trucks to said body at the height of said axles, said means including a king pin supported in said frame of a respective truck at the height of said axles and fastened to said body in a transverse center plane of a respective truck; and a pair of secondary springs, each said secondary spring being disposed between a respective truck and said body for supporting said body on said respective truck, each said secondary spring being disposed between said transverse center plane of a respective truck and an adjacent end of said vehicle body to effect a loading of the two respective outer axles by a larger share of the weight force of said body than the two inner axles.

4. A vehicle as set forth in claim 3 wherein each secondary spring is disposed on a longitudinal centerline spaced from said center plane.

5. A vehicle as set forth in claim 3 wherein each secondary spring is located in a plane between said king pin and a respective one of primary springs.

6. A vehicle as set forth in claim 3 wherein each said king pin is vertically guided in a respective truck in slidable relation.

* * * * *